US005676459A

United States Patent [19]

Bedford et al.

[11] Patent Number: 5,676,459

[45] Date of Patent: Oct. 14, 1997

[54] VIBRATION-TOLERANT LAMP MOUNTING ASSEMBLY

[75] Inventors: James P. Bedford, Willoughby; David Stuart Schwerzler, Chagrin Falls, both of Ohio

[73] Assignee: Cleveland Range, Inc., Cleveland, Ohio

[21] Appl. No.: 659,060

[22] Filed: Jun. 4, 1996

[51] Int. Cl.[6] ..... F21V 15/04

[52] U.S. Cl. ..... 362/390; 362/92; 362/133; 362/295; 362/369

[58] Field of Search ..... 362/92, 94, 100, 362/133, 145, 154, 156, 295, 306, 369, 370, 390, 432

[56] References Cited

U.S. PATENT DOCUMENTS

| | | | |
|---|---|---|---|
| 2,148,787 | 2/1939 | Thomas | 362/94 |
| 2,644,882 | 7/1953 | Voda | 362/94 |
| 2,795,691 | 6/1957 | Solley, Jr. et al. | 362/94 |
| 3,028,208 | 4/1962 | Sharpe | 362/94 |
| 3,088,021 | 4/1963 | Monahan | 362/94 |
| 3,257,552 | 6/1966 | Converso | 362/390 |
| 4,329,736 | 5/1982 | Nelle et al. | 362/23 |
| 4,437,145 | 3/1984 | Roller et al. | 362/390 |
| 4,922,395 | 5/1990 | Roney | 362/390 |
| 5,463,541 | 10/1995 | Greene | 362/369 |
| 5,491,619 | 2/1996 | Gill | 362/294 |

*Primary Examiner*—Alan Cariaso
*Attorney, Agent, or Firm*—Ohlandt, Greeley, Ruggiero & Perle

[57] ABSTRACT

A door-mounted vibration-tolerant lamp assembly comprising: a brace for mounting the lamp assembly to an exterior surface of a door, the door mounting brace having a body section and at least one mounting bracket disposed outwardly from the body section; an elastic mount having a first and second mounting bracket, wherein the first mounting bracket is affixed to the mounting bracket of the door mounting brace and the second mounting bracket is capable of supporting a lamp thereon; at least one first resilient pad disposed between the first mounting bracket of the elastic mount and the mounting bracket of the door mounting brace such that the resilient pad absorbs a substantial amount of the vibration that is generated when the door is moved to a closed position; and at least one second resilient pad disposed on the elastic mount in closer proximity to the second mounting bracket than to the first mounting bracket such that the second resilient pad acts to dampen movement of the lamp and the elastic mount when the door is moved to the closed position and when power is applied to the lamp.

8 Claims, 4 Drawing Sheets

VIBRATION-TOLERANT LAMP MOUNTING ASSEMBLY

This invention relates to a lamp mounting assembly which can better tolerate vibration and shock than conventional lamp mounting assemblies. This mounting assembly is suitable for mounting on movable surfaces such as rotisserie oven doors.

BACKGROUND OF THE INVENTION

It is well known that lamps which are subjected to repeated or intense vibration and shock typically fail and must be replaced far more rapidly than other lamps. The delicate nature of the lamp glass and metal filament, among other things, contributes to the vulnerability of lamps to outside stressors. In addition, lamps in these circumstances are more apt to shatter or explode. This constitutes a serious safety concern.

Nonetheless, many designs which require lighting also require lamps to be mounted on surfaces which must accept repeated and intense vibration and shock. The inventors herein have developed a unique mounting apparatus for installing a lamp in such a setting. This mounting apparatus serves to dampen the forces applied to the mounting surface, so that substantially less, and/or optimally, no vibration or impact ultimately reaches the lamp.

Lights mounted on movable surfaces are subject to stresses and vibrations of much greater magnitude than are those mounted on stationary surfaces. Furthermore, lights mounted to doors that engage and lock only with the application of substantial force are vulnerable to even greater shocks and vibrations. These vibrations can lead to the rapid degradation of the light filament, which is extremely delicate and can easily be damaged by repeated or intense shocks. The inventors have developed a novel mounting assembly for mounting a lamp that effectively dampens the vibrations that are transmitted to a door mounted lamp. This mounting assembly also includes a time delay relay switch to allow vibrations to subside before allowing electricity to pass to the lamp. This delay mechanism also contributes to maximizing lamp life. In addition, this mounting assembly includes a mechanism for gradually turning the lamp on, once power is on. This gradual brightening function also serves to enhance lamp life.

SUMMARY OF THE INVENTION

The door-mounted vibration-tolerant lamp assembly of the present invention comprises: a means for mounting the lamp assembly to an exterior surface of a door, the door mounting means having a body section and at least one mounting bracket disposed outwardly from the body section; an elastic mounting means having a first and second mounting bracket, wherein the first mounting bracket is affixed to the mounting bracket of the door mounting means and the second mounting bracket is capable of supporting a lamp thereon; at least one first resilient pad disposed between the first mounting bracket of the elastic mounting means and the mounting bracket of the door mounting means such that the resilient pad absorbs a substantial amount of the vibration that is generated when the door is moved to a closed position; and at least one second resilient pad disposed on the elastic mounting means in closer proximity to the second mounting bracket than to the first mounting bracket such that the second resilient pad acts to dampen movement of the lamp and the elastic mounting means when the door is moved to the closed position and when power is applied to the lamp.

Other embodiments are disclosed wherein the resilient pads have one or more integral holes to accept attaching means, wherein the resilient pads are attached to the elastic mounting means by screws inserted through the integral holes in the resilient pads, wherein the elastic mounting means is attached to the mounting bracket by means of loose nut plates and screws that have a resilient insert, and wherein the resilient insert is formed of nylon.

The present invention also encompasses a lamp assembly further comprising a time delay mechanism to control power to the lamp, a mechanism for gradually turning on the lamp, a first switch that, when activated, causes the time delay mechanism, or the mechanism for gradually turning on the lamp, or both, to be activated, and a second switch that, only when activated sequentially or simultaneously with the first switch, cause the time delay mechanism, or the mechanism for gradually turning on the lamp, or both, to be activated.

A further preferred embodiment is a door-mounted vibration-tolerant lamp assembly which comprises: a means for mounting the lamp assembly to an exterior surface of a door, the door mounting means having a body section and a first and a second mounting bracket disposed substantially perpendicularly from the body section; two elastic mounting means, each having an inner and an outer mounting bracket, wherein the outer mounting brackets of the first and second elastic mounting means are affixed to the first and second mounting brackets of the door mounting means, and the inner mounting brackets of the first and second elastic mounting means are capable of supporting a lamp thereon; one first resilient pad disposed between each of the outer mounting brackets of the elastic mounting means and the first and second mounting brackets of the door mounting means such that the resilient pads absorb a substantial mount of the vibration that is generated when the door is moved to a closed position; and a second resilient pad disposed on each of the elastic mounting means in closer proximity to the inner mounting bracket than to the outer mounting bracket such that the second resilient pad acts to dampen movement of the lamp and the elastic mounting means when the door is moved to the closed position and when power is applied to the lamp.

It is thus an object of this invention to provide a lamp mounting assembly which maximizes lamp life and minimizes lamp damage and the need for lamp replacement. Another object of this invention is to provide a lamp mounting assembly which dampens vibrations imparted to a lamp from the mounting surface.

Another object of this invention is to provide a lamp mounting assembly suitable for use on moving surfaces, and in particular, moving surfaces which are subject to vibrational or impact forces. Another object of this invention is to provide a lamp mounting assembly that utilizes a time delay relay switch to send electricity to the lamp only after sufficient damping of vibration and shock has occurred to allow safe operation. A further object of this invention is to provide a lamp mounting assembly which utilizes a mechanism that allows the lamp to be powered and lit gradually (like a dimmer switch) to maximize lamp life.

These and other objects and advantages of the lamp mounting assembly of the present invention will be apparent to those skilled in the art from the following description of preferred embodiments, claims and appended drawings.

DESCRIPTION OF THE PREFERRED EMBODIMENTS

In a preferred embodiment of the present invention, the lamp mounting assembly is attached to the exterior of an oven door to provide illumination to the working area and the contents of the oven. This oven door is subject to repeated opening and closing, to slamming, accidental jarring, and to the forces required to engage the door fastening mechanism. To minimize the vibrations and shock imparted to the lamp, the mounting assembly of the current invention is employed.

Figure 1:
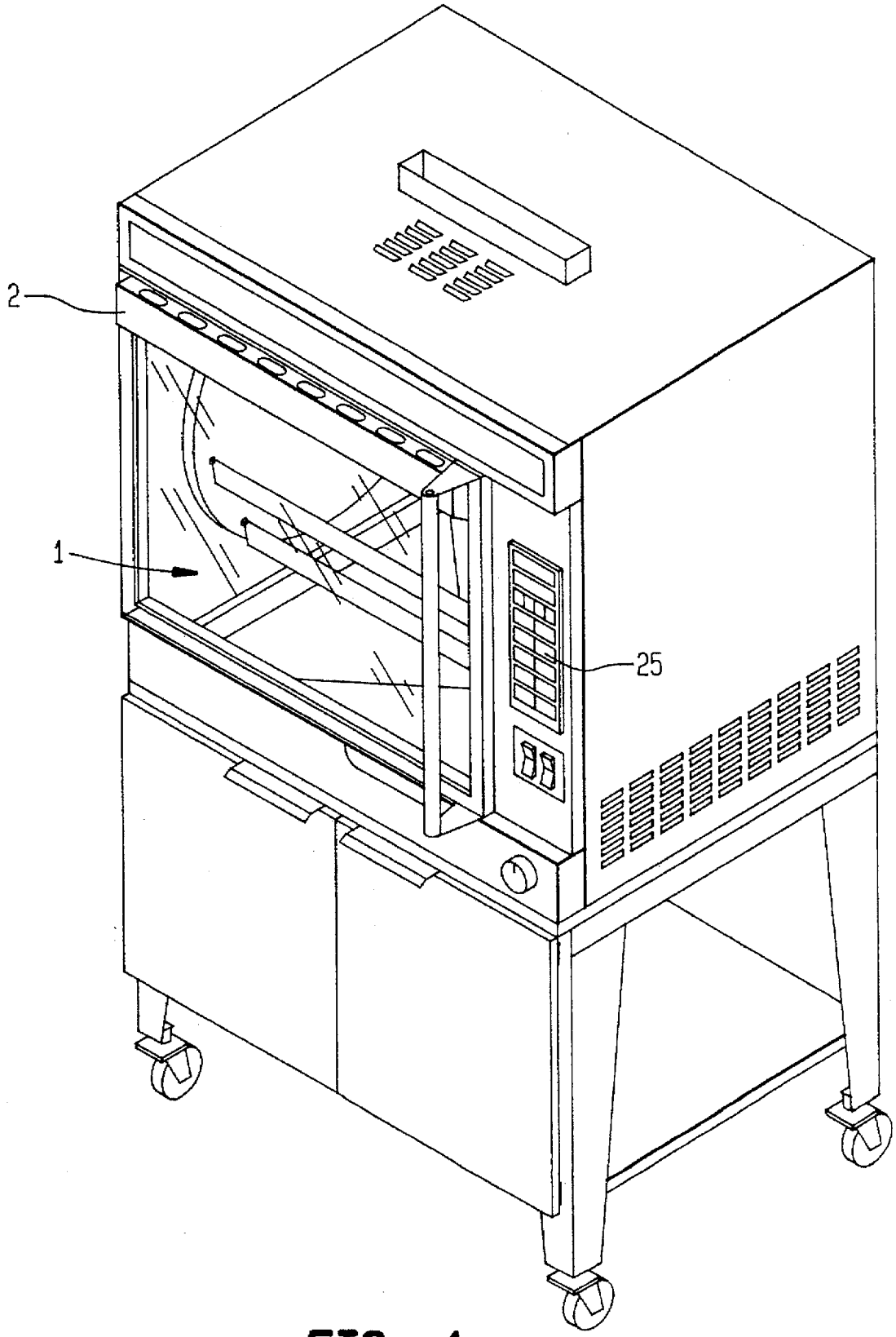
FIG. 1 is a perspective view of an oven comprising a preferred lamp assembly of the present invention.
Figure 2:
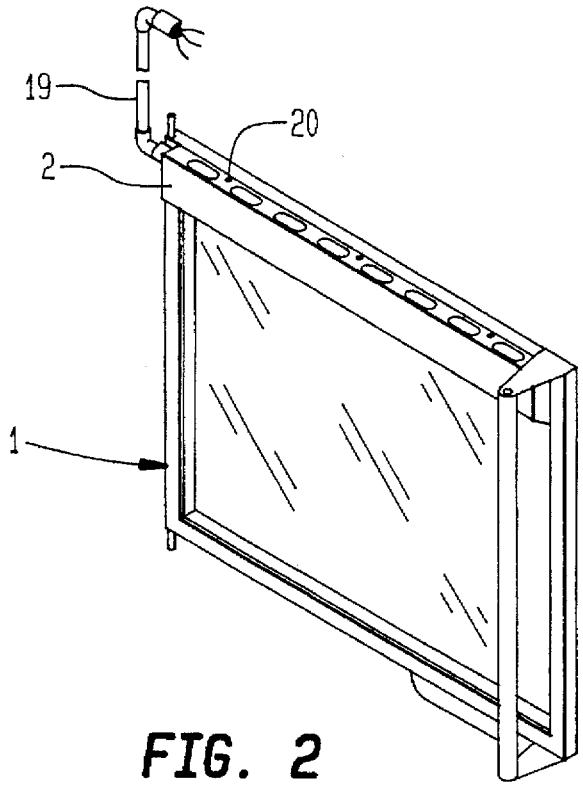
FIG. 2 is a perspective view of a preferred lamp assembly of the present invention as installed on an oven door.
Figure 4:
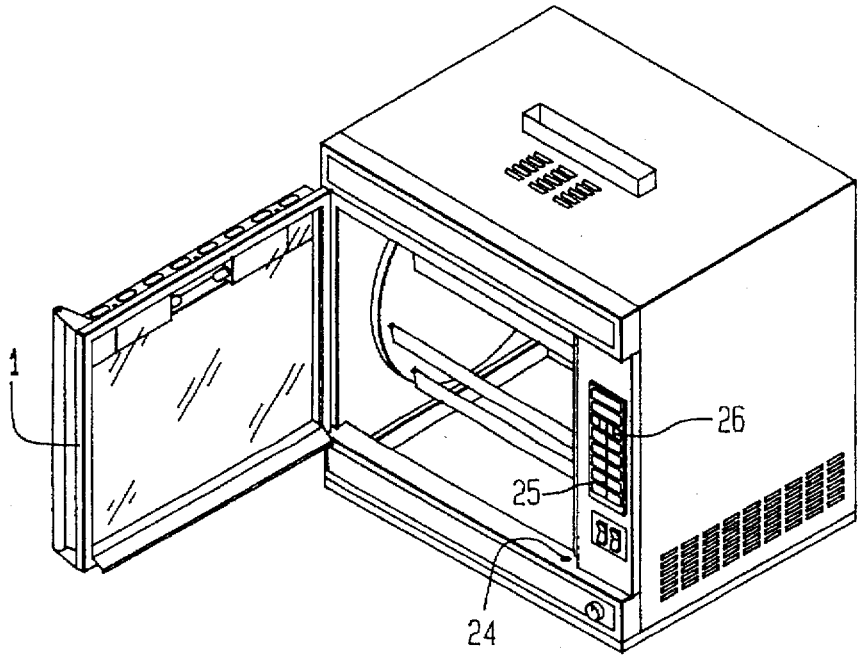
FIG. 4 is a perspective view of an oven comprising a preferred lamp assembly of the present invention, wherein the oven door is open.
Figure 3:
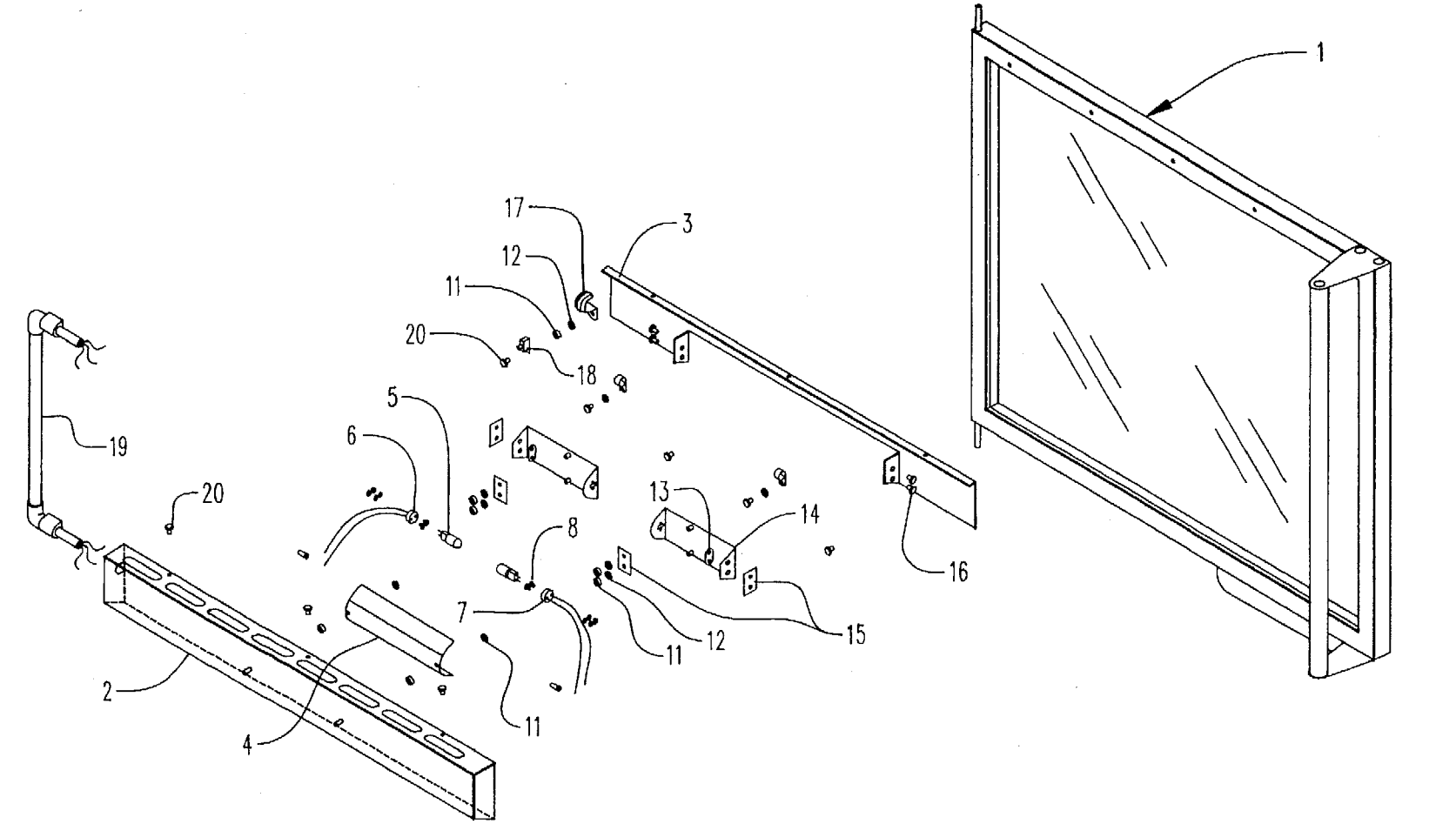
FIG. 3 is an exploded perspective view of a preferred embodiment of the lamp mounting assembly of the present invention.

The features of this preferred embodiment may be demonstrated and understood with reference to FIGS. 1–4. Oven door 1 constitutes the mounting surface herein. As seen in FIG. 3, mounting bracket 3 is rigidly attached to the oven door 1 by means of screws 20. Screws 20 pass through and attach grounding lug 18, elastic lock nut 11, flat washer 12, and rigid clamp 17 to mounting plate 3. Rigid clamp 17 accepts cable assembly 19 which in turn supplies electricity to the mounting assembly. A grounding wire in cable assembly 19 is attached to ground lug 18 to effectively ground the mounting assembly.

Two elastic mounts 14 are movably attached to mounting bracket 3 by resilient screws 16 having nylon inserts and loose washers 16. Resilient pads 15, made of silicone rubber, are situated between the abutted surfaces of mounting bracket 3 and elastic mounts 14. Screws 16 pass through holes integral in resilient pads 15 and are affixed by two-hole nuts 13. Additional resilient pads 15 are attached to the front surfaces of elastic mounts 14 by means of screws passing through elastic lock nuts 11 and flat washers 12. These resilient pads are located approximately two-thirds of the length of the elastic mount away from the first resilient pads. Pins of lamp sockets 6 and 7 extend through apertures in elastic mounts 14 and engagingly accept lamps 5 which sit between elastic mounts 14 and face one another. Truss head screws 8 extend through and attach sockets 6 and 7 to elastic mounts 14. Thus, sockets 6 and 7 rest against the second set of resilient pads 15 that are mounted to the front face of elastic mounts 14. Lamp reflector 4 is attached to heat shield 2. Heat shield 2 is then affixed to mounting bracket 3, completing the mounting assembly.

In a further preferred embodiment, the mounting assembly also comprises a time delay relay switch 24. This switch 24 allows the mounting assembly to completely or adequately dampen applied forces before the lamp is activated. This switch could also be incorporated into the assembly of FIG. 3 within sockets 6 and 7, or in a switch located on the oven or oven door 1 or other control surface.

In another preferred embodiment, the mounting assembly also comprises a gradual activation mechanism or dimmer 30 which allows the lamp to come on gradually, slowly progressing from off to dim to bright. This mechanism also functions to maximize lamp life. In the preferred embodiment shown by FIG. 3, this mechanism could be incorporated into the sockets 6 and 7, or could be controlled by a switch 24 located on the oven or oven door 1 or other control surface 25.

Figure 5:
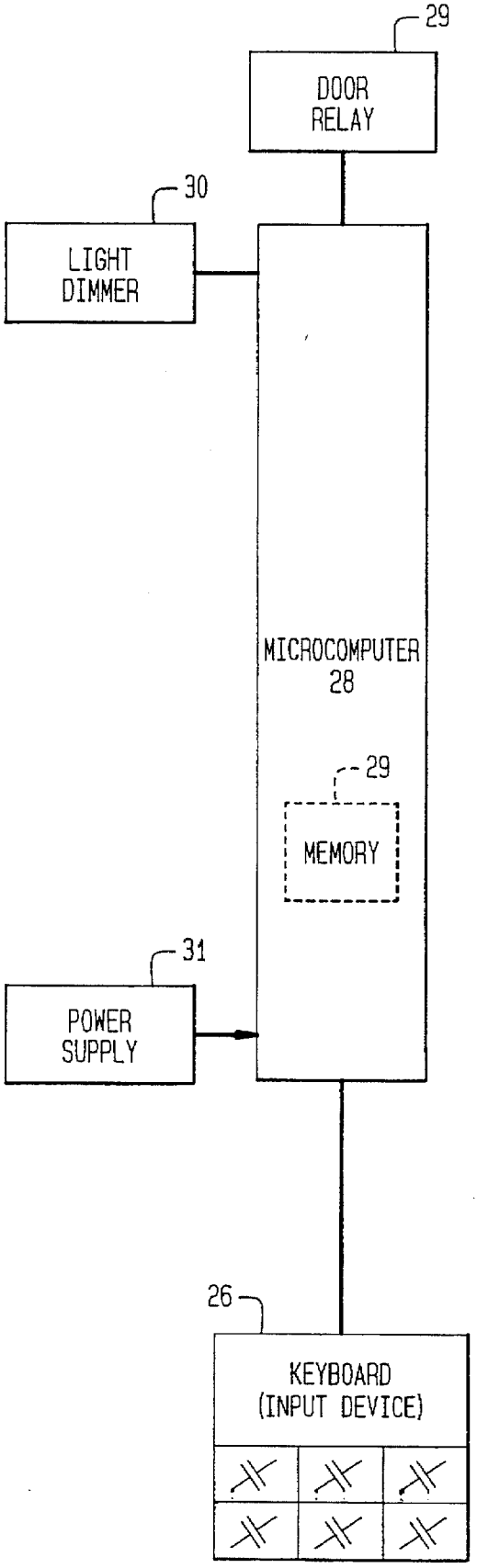
FIG. 5 is a diagram of the electrical circuitry of a preferred lamp assembly of the present invention.

In a further preferred embodiment, activation by an operator of two switches 26, either sequentially or simultaneously, causes either the time delay or the gradual-on mechanism or both to be activated (see FIG. 5).

As shown in FIG. 5, in one embodiment, when door 1 is moved to a closed position, relay switch 24 is activated. Time delay relay 24 sends a signal to microcomputer 28 having memory 29. Microcomputer 28 sends a signal to light dimmer 30 after the appropriate time has passed, as stored in memory 29. Light dimmer 30 is then activated, and gradually sends current from power supply 31 to lamp 5. Lamp 5 is then gradually lit.

Other preferred embodiments are apparent from this disclosure. For example, this lamp mounting apparatus is suitable for any vehicle, appliance, cabinet, or other door lamp. The resilient pads, elastic mounts and mounting brackets can be used in different shapes and spatial orientations, suitable to other functions. Resilient pads can be used in multiples at each attachment point, and can be added to other points of contact. The resilient pads can be attached with adhesive or other means of attachment. The "lamp" of the present invention can also cover any similarly sensitive device which must be mounted, such as a thermometer or other sensor. These examples are demonstrative of, but do not limit, the various uses and applications to which the lamp mounting apparatus of the present invention is suited.

What is claimed is:

1. A door-mounted vibration-tolerant lamp assembly which comprises:

(a) a means for mounting said lamp assembly to an exterior surface of a door, said door mounting means having a body section and at least one mounting bracket disposed outwardly from said body section;

(b) an elastic mounting means having a first and second mounting bracket, wherein said first mounting bracket is affixed to said mounting bracket of said door mounting means and said second mounting bracket is capable of supporting a lamp thereon;

(c) at least one first resilient pad disposed between said first mounting bracket of said elastic mounting means and said mounting bracket of said door mounting means such that said resilient pad absorbs a substantial amount of the vibration that is generated when said door is moved to a closed position; and (d) at least one second resilient pad disposed on said elastic mounting means in closer proximity to said second mounting bracket than to said first mounting bracket such that said second resilient pad acts to dampen movement of said lamp and said elastic mounting means when said door is moved to said closed position and when power is applied to said lamp.

2. The lamp assembly of claim 1, further comprising a time delay mechanism to control power to said lamp.

3. The lamp assembly of claim 1, further comprising a mechanism for gradually turning on said lamp.

4. The lamp assembly of claim 2, further comprising a first switch that, when activated, causes said time delay mechanism to be activated alone or in conjunction with a mechanism for gradually turning on said lamp.

5. The lamp assembly of claim 3, further comprising a first switch that, when activated, causes said mechanism for gradually turning on said lamp to be activated alone or in conjunction with a time delay mechanism.

6. The lamp assembly of claim 4, further comprising a second switch that, only when activated sequentially or simultaneously with said first switch, causes said time delay mechanism, or both said time delay mechanism and said mechanism for gradually turning on said lamp, to be activated.

7. The lamp assembly of claim 5, further comprising a second switch that, only when activated sequentially or simultaneously with said first switch, causes said mechanism for gradually turning on said lamp, or both said mechanism for gradually turning on said lamp and said time delay mechanism, to be activated.

8. A door-mounted vibration-tolerant lamp assembly which comprises:

(a) a means for mounting said lamp assembly to an exterior surface of a door, said door mounting means having a body section and a first and a second mounting bracket disposed substantially perpendicularly from said body section;

(b) two elastic mounting means, each having an inner and an outer mounting bracket, wherein said outer mounting brackets of said first and second elastic mounting means are affixed to said first and second mounting brackets of said door mounting means, and said inner mounting brackets of said first and second elastic mounting means are capable of supporting a lamp thereon;

(c) one first resilient pad disposed between each said outer mounting bracket of said elastic mounting means and said first and second mounting brackets of said door mounting means such that said resilient pads absorb a substantial amount of the vibration that is generated when said door is moved to a closed position; and (d) a second resilient pad disposed on each said elastic mounting means in closer proximity to said inner mounting bracket than to said outer mounting bracket such that said second resilient pad acts to dampen movement of said lamp and said elastic mounting means when said door is moved to said closed position and when power is applied to said lamp.

* * * * *